US007234311B2

(12) United States Patent
Lifson et al.

(10) Patent No.: US 7,234,311 B2
(45) Date of Patent: Jun. 26, 2007

(54) PREVENTION OF COMPRESSOR UNPOWERED REVERSE ROTATION IN HEAT PUMP UNITS

(75) Inventors: Alexander Lifson, Manlius, NY (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 240 days.

(21) Appl. No.: 11/098,363

(22) Filed: Apr. 4, 2005

(65) Prior Publication Data

US 2006/0218947 A1 Oct. 5, 2006

(51) Int. Cl.
*F25B 1/00* (2006.01)

(52) U.S. Cl. ..... 62/115; 62/160; 62/238.7; 62/324.1

(58) Field of Classification Search ..... 62/115, 62/127, 160, 157, 163, 155, 158, 238.7, 324.1, 62/324.6
See application file for complete search history.

(56) References Cited

U.S. PATENT DOCUMENTS 4,301,660 A * 11/1981 Mueller et al. ..... 62/126
4,316,365 A * 2/1982 Mueller et al. ..... 62/151
4,417,452 A * 11/1983 Ruminsky et al. ..... 62/155
4,484,452 A * 11/1984 Houser, Jr. ..... 62/174
4,882,908 A * 11/1989 White ..... 62/155
4,940,079 A * 7/1990 Best et al. ..... 165/236
5,237,830 A * 8/1993 Grant ..... 62/155
5,465,588 A * 11/1995 McCahill et al. ..... 62/127
5,507,337 A * 4/1996 Rafalovich et al. ..... 165/63
5,680,898 A * 10/1997 Rafalovich et al. ..... 165/236
6,263,686 B1 * 7/2001 Burkhart ..... 62/155
6,334,321 B1 * 1/2002 Said et al. ..... 62/155
2006/0053822 A1 * 3/2006 Taras et al. ..... 62/324.1

FOREIGN PATENT DOCUMENTS

EP 0514086 A2 * 11/1992

* cited by examiner

*Primary Examiner*—Mohammad M. Ali
(74) *Attorney, Agent, or Firm*—Carlson, Gaskey & Olds

(57) ABSTRACT

A heat pump is provided with a method and control for eliminating compressor un-powered reverse rotation at shutdown. In particular, the position of the four-way reversing valve is changed and the heat pump is moved to the opposite mode of operation as compared to the one it had been operated before shutdown. The compressed refrigerant, that might otherwise re-expand through the compressor and cause the compressor to run in reverse, is now communicated to the suction line of the compressor, while the discharge port of the compressor communicates with a refrigerant at suction pressure. Thus the unpowered reverse rotation of the compressor is no longer possible.

23 Claims, 1 Drawing Sheet

PREVENTION OF COMPRESSOR UNPOWERED REVERSE ROTATION IN HEAT PUMP UNITS

BACKGROUND OF THE INVENTION

This invention relates to a method that switches a heat pump into an opposite mode of operation at shutdown to eliminate un-powered reverse rotation.

Refrigerant systems are utilized to control the temperature and humidity of air in various indoor environments to be conditioned. In a typical refrigerant system operating in the cooling mode, a refrigerant is compressed in a compressor and delivered to a condenser (or outdoor heat exchanger in this case). In the condenser, heat is exchanged between outside ambient air and the refrigerant. From the condenser, the refrigerant passes to an expansion device, at which the refrigerant is expanded to a lower pressure and temperature, and then to an evaporator (or indoor heat exchanger). In the evaporator, heat is exchanged between the refrigerant and the indoor air, to condition the indoor air. When the refrigerant system is operating, the evaporator cools the air that is being supplied to the indoor environment.

The above description is of a refrigerant system being utilized in a cooling mode of operation. In the heating mode, the refrigerant flow through the system is essentially reversed. The indoor heat exchanger becomes the condenser and releases heat into the environment to be conditioned (heated in this case) and the outdoor heat exchanger serves the purpose of the evaporator and exchangers heat with a relatively cold outdoor air. Heat pumps are known as the systems that can reverse the refrigerant flow through the refrigerant cycle in order to operate in both heating and cooling modes. This is usually achieved by incorporating a four-way reversing valve or an equivalent device into the system schematic downstream of the compressor discharge port. The four-way reversing valve selectively directs the refrigerant flow through the indoor or outdoor heat exchanger when the system is in the heating or cooling mode of operation respectively. Furthermore, if the expansion device cannot handle the reversed flow, than a pair of expansion devices, each along with a check valve, are employed instead.

A problem known as "unpowered reverse rotation" can occur with certain types of compressors at shutdown. With certain types of compressors, such as for example screw compressors or scroll compressors, the compressed refrigerant can move back inwardly towards the compression chambers at shutdown. This refrigerant would re-expand causing compression elements to rotate in the reverse direction at high speed. This is undesirable, as it results in unwanted highly offensive noise, and can even cause potential damage to the compressor.

Discharge check valves have been incorporated into the compressor design to prevent this reverse flow of compressed refrigerant from entering compression chambers, however, these check valves are relatively expensive to incorporate into the compressor design, suffer from their own reliability problems, and thus have not always been successful in preventing reverse rotation. Consequently, it is desirable to prevent un-power reverse rotation, while eliminating installation of the check valve or adding redundancy if the check valve malfunctions.

SUMMARY OF THE INVENTION

In a disclosed embodiment of this invention, a heat pump is moved to a reverse mode of operation at shutdown, from the mode it was before shutdown. As an example, assume a heat pump had been operating in a cooling mode before shutdown. In accordance with this invention, the system controls would move the four-way reversing valve to the heating mode position at compressor shutdown to prevent backflow of compressed refrigerant to the compressor. In this case, the compressed (high pressure) refrigerant downstream of the compressor would be connected to the compressor inlet. In this manner, there is no backflow of compressed refrigerant to the compressor. Consequently, the pressure will equalize across the compressor in a short period of time, with no reverse rotation present while the refrigerant is moving from compressor suction to compressor discharge.

The opposite mode switching sequence would be initiated at the shutdown if the heat pump had been operating in a heating mode before shutdown. In other words, the four-way reversing valve would be moved to the cooling mode position at compressor shutdown.

In particular, the inventive method is utilized in a heat pump having the type of compressor that is subject to reverse rotation. Such compressors include but not limited to scroll compressors and screw compressors. With the present invention, it may be possible to entirely eliminate a discharge check valve that was used in the past to prevent the backflow of refrigerant through the compressor after compressor shutdown.

These and other features of the present invention can be best understood from the following specification and drawings, the following of which is a brief description.

DETAILED DESCRIPTION OF THE PREFERRED EMBODIMENT

Figure 1A:
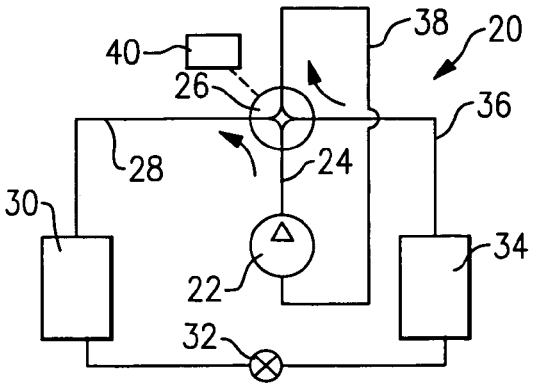
FIG. 1A shows a heat pump, as it would normally operate in a cooling mode.

FIG. 1A shows a heat pump 20 operating in a cooling mode. As known, compressor 22 delivers a compressed refrigerant into a discharge line 24 leading to a four-way reversing valve 26.

In the cooling mode, the refrigerant passes through the four-way reversing valve 26 from the discharge line 24 to a line 28 leading to an outdoor heat exchanger 30. From the outdoor heat exchanger 30, the refrigerant passes through an expansion device 32, and to an indoor heat exchanger 34. A line 36 is positioned downstream of the indoor heat exchanger 34, and passes refrigerant once again through the four-way reversing valve 26 and then to a suction line 38 returning it to the compressor 22. A control 40 controls the position of the four-way reversing valve 26.

Figure 1B:
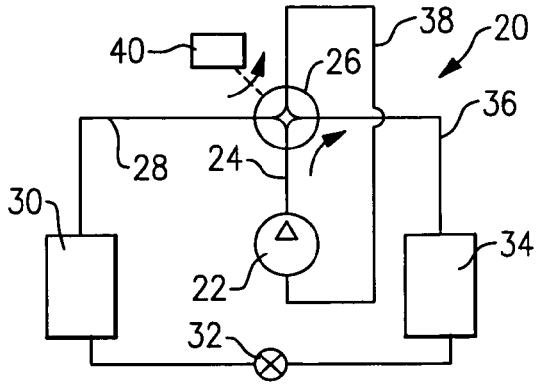
FIG. 1B shows a shutdown position for the heat pump previously operating in a cooling mode.

As mentioned above, the present invention eliminates compressor unpowered reverse rotation by moving the four-way reversing valve 26 such that the heat pump 20 is in the reverse mode of operation (in this case heating mode), at or just before shutdown, Thus, as shown in FIG. 1B, the discharge line 24 now communicates through the four-way reversing valve 26 to the line 36, and to the indoor heat exchanger 34. The previously compressed refrigerant returns through the expansion device 32, outdoor heat exchanger 30, line 28 and the four-way reversing valve 26 back to the suction line 38. The problem associated with reverse rotation is thus eliminated.

When the switch in the four-way reversing valve position is executed as shown in FIG. 1B, the compressed refrigerant, which had been delivered towards the heat exchanger 30, will now communicate to the suction line 38 of the compressor 22. Thus, no re-expansion of vapor form the discharge line will occur. Instead, the line 36, that had previously been connected to the suction line and included suction pressure refrigerant, would now be exposed to the compression chambers. Thus, the present invention will ensure that un-powered reverse rotation does not occur.

Figure 2A:
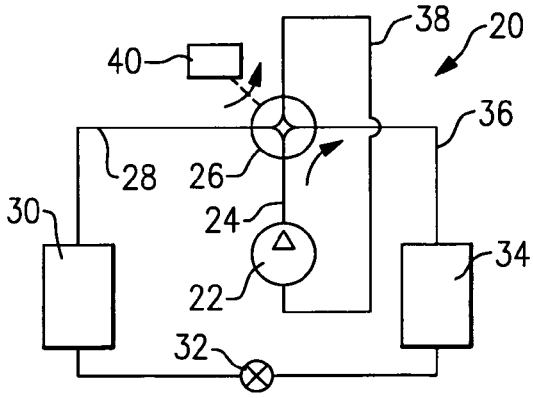
FIG. 2A shows a heat pump operating in a heating mode.
Figure 2B:
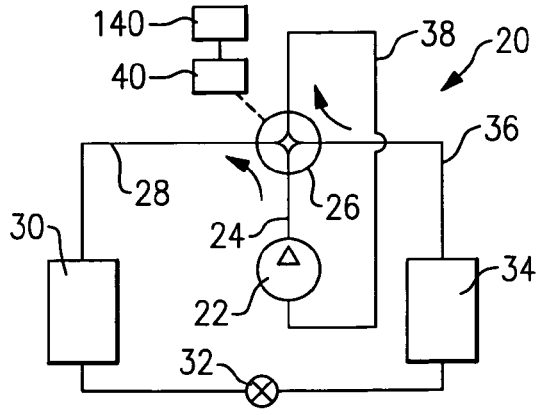
FIG. 2B shows a shutdown position for the heat pump previously operating in a heating mode.

FIG. 2A shows the heat pump 20 operating in heating mode. When the heat pump 20 is to be shut down in heating mode, the four-way reversing valve 26 will initially be moved to the cooling mode position, such as shown in FIG. 2B. Again, this will eliminate the problem of un-powered reverse rotation.

The switch between the modes can preferably be performed on the fly. That is, the valve 26 can be reversed without stopping the compressor and other system components. Alternatively, the switch can occur concurrently with the compressor 22 shutdown.

Figure 3:
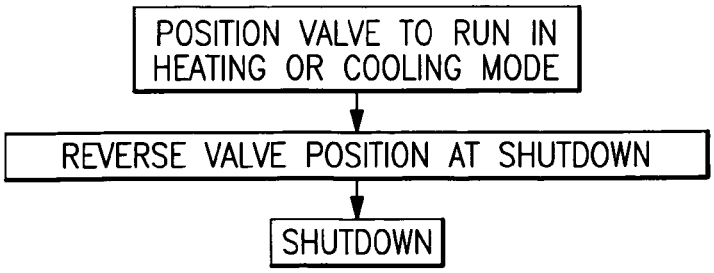
FIG. 3 is a flow chart of the present invention.

FIG. 3 is a brief flow chart of the present invention. The heat pump 20 is run in either a heating or cooling mode. At shutdown, the control 40 moves the four-way reversing valve 26 such that the heat pump 20 is in the reverse mode position.

The switching of the position of the four-way reversing valve 26 should preferably occur, within two seconds after shutdown or within 1 minute prior to shutdown More desirably, the shift should occur either less than five hundred milliseconds after shutdown, or less than 10 seconds prior to shutdown.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A heat pump comprising:

a compressor, said compressor delivering refrigerant to a discharge line, and receiving refrigerant from a suction line, said discharge line and said suction line communicating with a reversing valve, said reversing valve being movable between a heating position and a cooling position, said reversing valve directing refrigerant between an indoor heat exchanger and an outdoor heat exchanger in opposite flow directions in said heating position and in said cooling position, and a control for said reversing valve, said control being programmed to move said reversing valve to the opposite position relative to a current position at shutdown, said movement of said reversing valve to the opposite position occurring within one minute prior to shutdown.

2. The heat pump as set forth in claim 1, wherein said current position provides a cooling mode, and said opposite position is a heating mode.

3. The heat pump as set forth in claim 1, wherein said current position provides a heating mode, and said opposite position is a cooling mode.

4. The heat pump as set forth in claim 1, wherein said reversing valve is a four-way reversing valve.

5. The heat pump as set forth in claim 1, wherein said movement of said reversing valve to the opposite position occurs no earlier than 10 seconds prior to shutdown.

6. The heat pump as set forth in claim 1, wherein there is no discharge check valve between said compressor and said reversing valve.

7. The heat pump as set forth in claim 1, wherein said compressor is a screw compressor.

8. The heat pump as set forth in claim 1, wherein said compressor is a scroll compressor.

9. A heat pump comprising:

a compressor, said compressor delivering refrigerant to a discharge line, and receiving refrigerant from a suction line, said discharge line and said suction line communicating with a reversing valve, said reversing valve being movable between a heating position and a cooling position, said reversing valve directing refrigerant between an indoor heat exchanger and an outdoor heat exchanger in opposite flow directions in said heating position and in said cooling position, and a control for said reversing valve, said control being programmed to move said reversing valve to the opposite position relative to a current position at shutdown; and said movement of said reversing valve to the opposite position occurring no later than two second after shutdown.

10. The heat pump as set forth in claim 9, wherein said movement of said reversing valve to the opposite position occurs no later than five hundred milliseconds after shutdown.

11. The heat pump as set forth in claim 9, wherein said compressor is a screw compressor.

12. The heat pump as set forth in claim 9, wherein said compressor is a scroll compressor.

13. A method of operating a heat pump comprising the steps of:

(1) operating said heat pump in one of a cooling and heating mode;

(2) deciding to shut down said heat pump;

(3) moving said heat pump to operate in the other of said cooling and heating modes;

(4) shutting down a compressor associated with the heat pump either shortly before or after, or at the same time as step 3; and (5) moving said heat pump to operate in the other of said cooling and heating modes within one minute prior to shutdown.

14. The method as set forth in claim 13, wherein said movement of said heat pump to operate in the other of said cooling and heating modes occurs no earlier than 10 seconds prior to shutdown.

15. The method as set forth in claim 13, wherein no discharge check valve is utilized on a compressor associate with said heat pump.

16. The method as set forth in claim 13, wherein said compressor is a screw compressor.

17. The method as set forth in claim 13, wherein said compressor is a scroll compressor.

18. The method as set forth in claim 13, where moving of heat pump from said one operating mode to the other is accomplished by means of reversing valve.

19. The method as set forth in claim 18, where the reversing valve is a four-way reversing valve.

20. A method of operating a heat pump comprising the steps of:

(1) operating said heat pump in one of a cooling and heating mode;

(2) deciding to shut down said heat pump;

(3) moving said heat pump to operate in the other of said cooling and heating modes;

(4) shutting down a compressor associated with the heat pump either shortly before or after, or at the same time as step 3;

(5) moving said reversing valve to the opposite position no later than two second after shutdown.

21. The method as set forth in claim 20, wherein said movement of said heat pump to operate in the other of said cooling and heating modes occurs no later than five hundred milliseconds after shutdown.

22. The method as set forth in claim 20, wherein said compressor is a screw compressor.

23. The method as set forth in claim 20, wherein said compressor is a scroll compressor.

* * * * *